US008147264B2

(12) United States Patent
Larkin

(10) Patent No.: US 8,147,264 B2
(45) **Date of Patent: *Apr. 3, 2012**

(54) CONNECTOR WITH FLEXIBLE RIB INTERFACE

(76) Inventor: Kevin B. Larkin, Pebble Beach, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/243,606

(22) Filed: Sep. 23, 2011

(65) Prior Publication Data

US 2012/0015538 A1 Jan. 19, 2012

Related U.S. Application Data

(63) Continuation of application No. 12/820,714, filed on Jun. 22, 2010, now Pat. No. 8,025,517, which is a continuation of application No. 12/240,177, filed on Sep. 29, 2008, now Pat. No. 7,766,682.

(51) Int. Cl.
*H01R 13/52* (2006.01)

(52) U.S. Cl. ..... 439/281

(58) Field of Classification Search ..... 439/281, 439/557, 357, 358, 352, 936, 587, 282
See application file for complete search history.

(56) References Cited

U.S. PATENT DOCUMENTS

| | | | | |
|---|---|---|---|---|
| 4,312,553 | A | 1/1982 | Lyckesjö | |
| 5,951,337 | A | 9/1999 | Brake | |
| 6,290,525 | B1 | 9/2001 | Jacobi | |
| 7,211,731 | B2 | 5/2007 | Nagamine et al. | |
| 7,232,337 | B1 | 6/2007 | Pepe et al. | |
| 7,306,469 | B1 | 12/2007 | Slautterback | |
| 7,338,304 | B2 | 3/2008 | Kameyama et al. | |
| 7,766,682 | B1 * | 8/2010 | Larkin | 439/281 |
| 8,025,517 | B2 * | 9/2011 | Larkin | 439/281 |
| 2004/0242063 | A1 | 12/2004 | Miyamoto | |

OTHER PUBLICATIONS

Notice of Allowance for U.S. Appl. No. 12/240,177 dated Mar. 23, 2010, 10 pgs.

Notice of Allowance for U.S. Appl. No. 12/820,714 dated May 17, 2011, 7 pgs.

* cited by examiner

*Primary Examiner* — Tulsidas C Patel

*Assistant Examiner* — Phuong Nguyen

(74) *Attorney, Agent, or Firm* — Morgan, Lewis & Bockius LLP

(57) ABSTRACT

One or more saw tooth shaped flexible ribs in between a connector interface provide asymmetric sliding resistance and a one sided sealing effect. The asymmetric sliding resistance provides for low frictional engaging resistance and for a high disengaging resistance of the connector interface. The one sided sealing effect provides in conjunction with an interface cavity for back flow resistance into the cavity during disengagement movement in the interface and for a vacuum effect that assists in opposing the disengagement movement. The flexible ribs may be monolithically fabricated together with the entire housing of the respective connector.

25 Claims, 4 Drawing Sheets

CONNECTOR WITH FLEXIBLE RIB INTERFACE

RELATED APPLICATIONS

This application is a continuation of U.S. application Ser. No. 12/820,714 filed Jun. 22, 2010, (U.S. Pat. No. 8,025,517), which is a continuation of U.S. application Ser. No. 12/240,177, filed Sep. 29, 2008 (U.S. Pat. No. 7,766,682), the disclosures of which are hereby incorporated herein

FIELD OF INVENTION

The present invention relates to flexible ribs in the connector interface of connectors that provide asymmetric friction resistance and one directional sealing.

BACKGROUND OF INVENTION

Signal transmitting connectors such as peripheral electrical connectors commonly employ an overall housing that is monolithically encompassing the connector's terminal(s) while providing a strain relief at the same time. Such overall housing is preferably made of plastic that is sufficiently soft to provide sufficient impact resistance and flexural elasticity for the integrated strain relief as is well known in the art. In the prior art, the electric terminal(s) have been also surrounded by a surrounding tubular protrusion that is intended to fit snugly into a mating female cavity of another connector or connector site. In that way, mechanical loads are transferred from the connector housing directly onto the other connector housing and the electrical terminal(s) remain substantially stress free. Unfortunately, the relatively soft nature of the tubular protrusion makes it difficult to provide an arresting feature that assists in keeping the connector connected against eventual pulling forces, vibrations and such. Therefore, there exists a need for an arresting feature for a tubular connector protrusion that can be fabricated from soft plastic material and that provides for an increased resistance against unplugging while keeping the required force for plugging in of the connector to a minimum. The present invention addresses this need.

SUMMARY

A surrounding tubular protrusion at a connector interface features continuous circumferential ribs that extend radially outward from the outside mating face of the surrounding tubular protrusion. The continuous circumferential ribs are of a softness that provides for sufficient deflection when the tubular protrusion is inserted into a mating female cavity. As two connectors are connected, the ribs are radially compressed and provide on one hand a snug connection such that a substantially air tight interface cavity is created inside the female cavity. The flexible ribs have a saw tooth like cross section that assists on one hand in a one directional venting of air out of the interface cavity during insertion while blocking air to flow back into the interface cavity while the connector is pulled out. This creates an ambient air pressure assisted arresting effect. On the other hand, the saw tooth like cross section provides for a low friction resistance during insertion and a high frictional resistance against pull out of the connector. The flexible ribs may be monolithically fabricated together with the surrounding tubular protrusion and the remainder of the housing.

DETAILED DESCRIPTION

Figure 1:
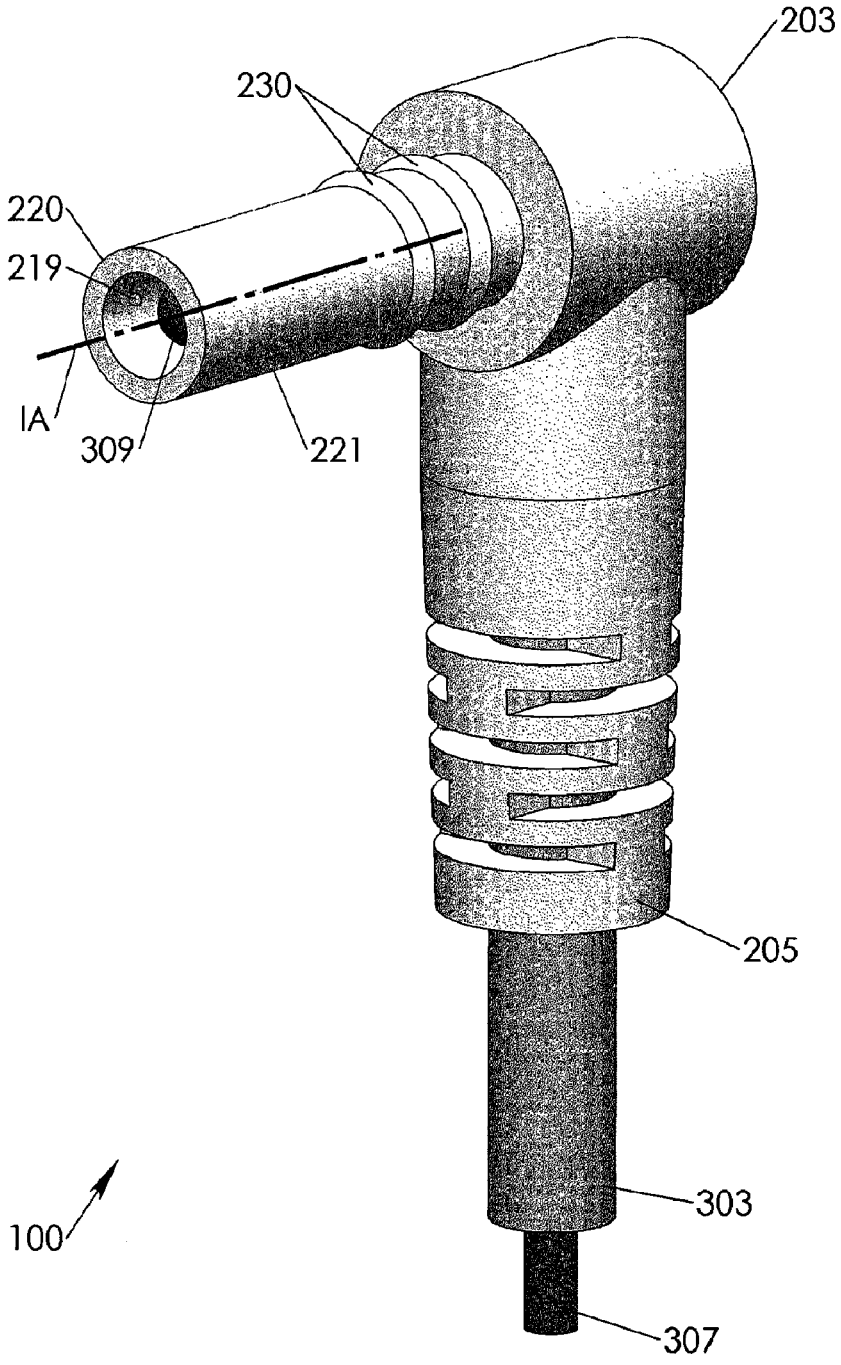
FIG. 1 is a perspective view of a connector according to a preferred embodiment of the invention.
Figure 2:
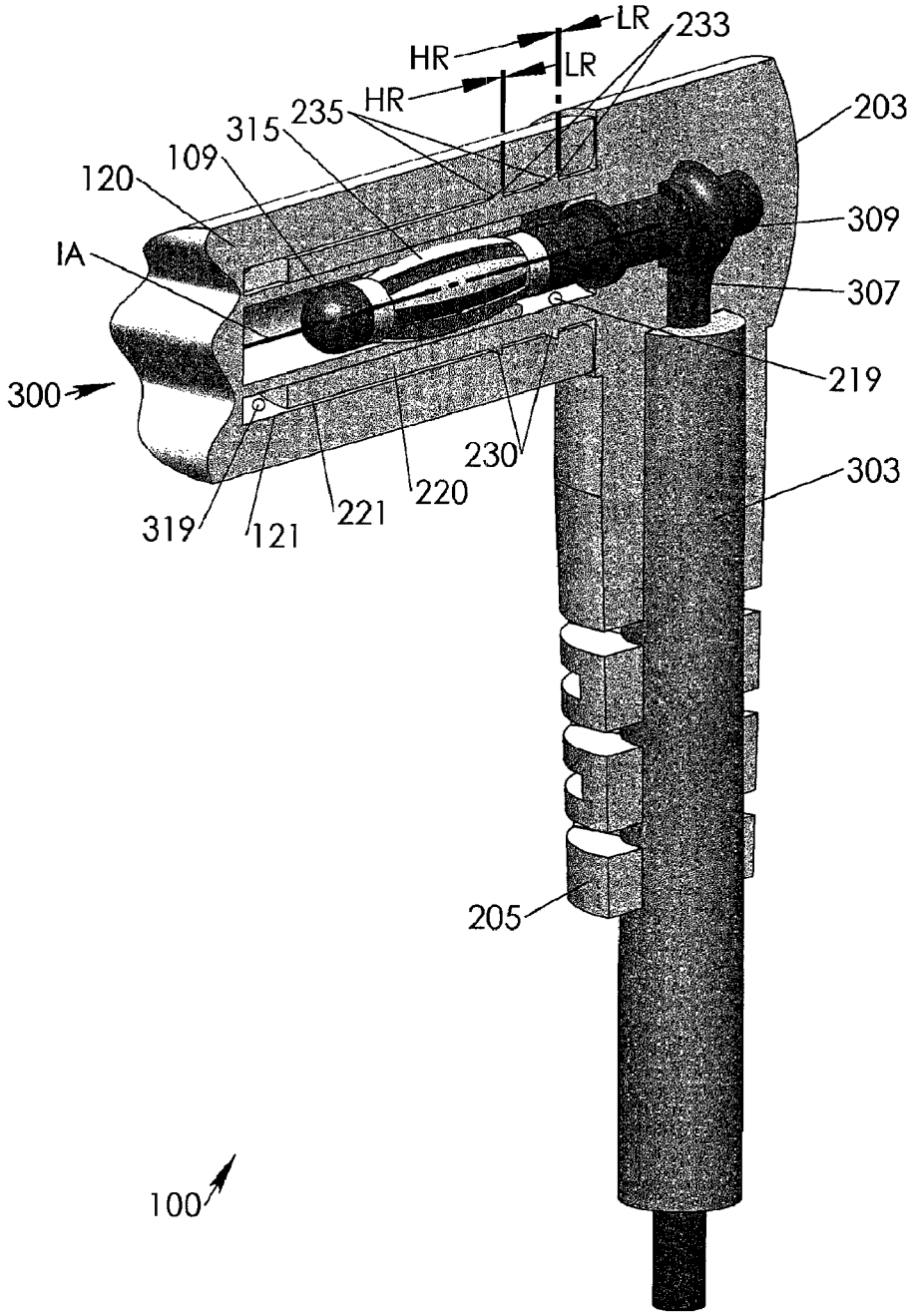
FIG. 2 is the perspective view with a housing of the connector of FIG. 1 and a connector interface being displayed in cut view.
Figure 3:
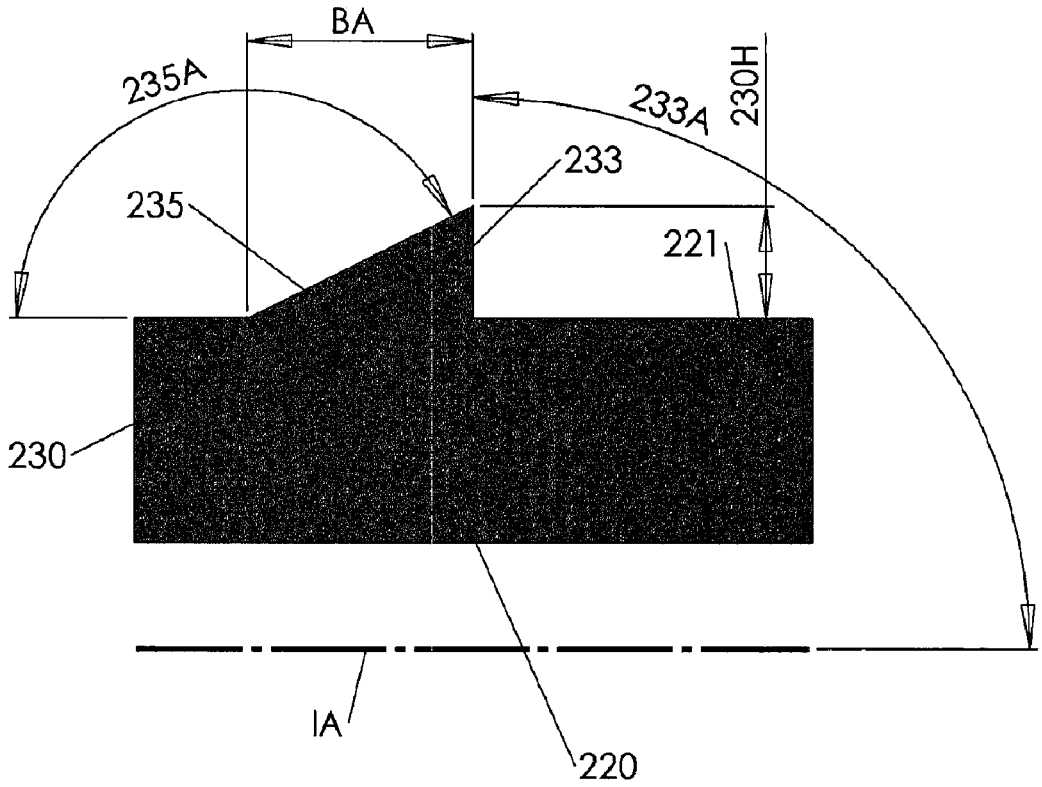
FIG. 3 is a detail section view of a flexible rib as in FIGS. 1, 2.

Referring to FIGS. 1-4, a connector 100 has an insertion axis IA along which it may be connector to another mating connector 300 a portion of which is depicted in FIG. 2. The connector 100 has a mating face 221 with one or more flexible ribs 230 that extend above the mating face 221 and propagate along the mating face 221 at least in a substantial angle with respect to the insertion axis IA. Preferably the flexible ribs 230 are perpendicular with respect to the insertion axis IA and circumferentially continuous on the outward mating face 221.

The flexible ribs 230 have a saw tooth cross section including a steep flank 233 and a shallow flank 235. The shallow flank 233 is in a first flank angle 235A with respect to the insertion axis IA and the steep flank 235 is in a second flank angle 233A with respect to the insertion axis IA. While the connector 100 is operationally connected, a connector interface may be defined with an opposing inward mating face 121 of the other mating connector 300.

Figure 4:
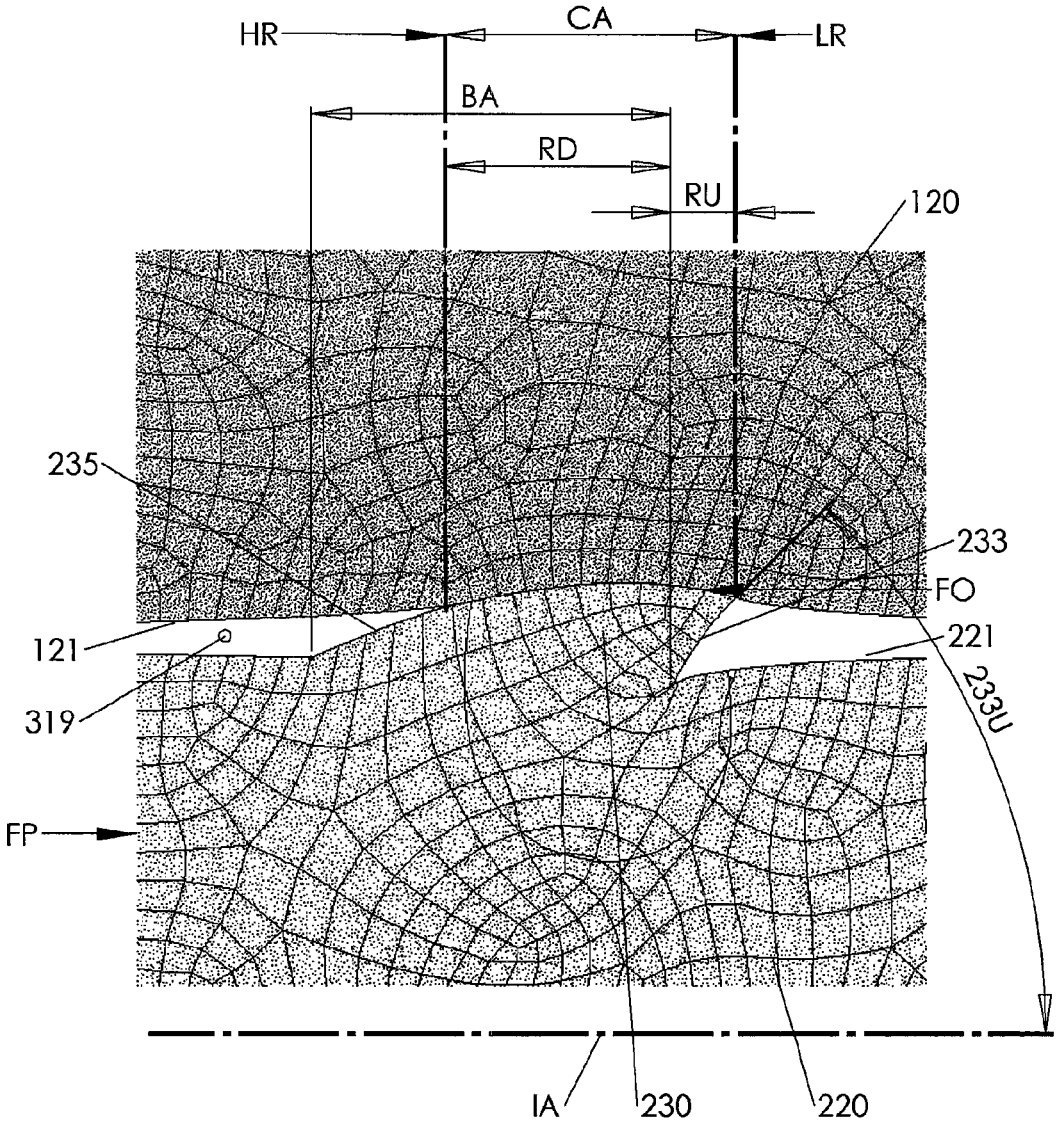
FIG. 4 is a finite displacement analysis computed with commercially available FEA software of a detail of the connection interface of FIG. 2, including the flexible rib of FIG. 3 under operational radial compression.

While the two connectors 100, 300 are connected and the connector interface 121, 221, 230 engaged, the other opposing mating face 121 may induce a substantially radial compression on the flexible ribs 230 as is representatively depicted in FIG. 4. Due to the saw tooth cross section, the flexible ribs 230 provide an asymmetric friction resistance against the opposing mating face 121 along the insertion axis IA. Also during operational radial compression, a substantial portion RD of the radial contact pressure area CA is within an axial base width BA of the flexible rib 230.

The asymmetric friction resistance is related to well known frictional surface contact. Referring to FIG. 4, the shallow flank 235 preferably is facing an insertion direction of the and the steep flank 233 is facing a pull out direction along the insertion axis IA such that the asymmetric friction resistance within the radial contact pressure area CA has a low friction resistance LR in the insertion direction and a high friction resistance HR in the pull out direction. This is due to a self amplifying friction effect in which the undercutting deformed rib portion RU is forced radially away from the axial base width BA in response to a pull out opposing axial friction force FO acting in opposition to the pull out force FP. This in turn increases the contact pressure and the maximum opposing axial friction force FO particular in between the undercutting deformed rib portion RU and the opposing mating face 121, resulting in an increase of the overall friction resistance HR within the contact pressure area CA.

The above described self amplifying friction effect is particularly accomplished by providing firstly a broad axial base with BA relative to the flexible rib height 230H for sufficient radial stiffness, which may be defined by a rib base to height ratio that may be preferably about 2. Secondly, a flank angle difference between the first flank angle 235A and the second flank angle 233A is selected such that during the substantially radial compression substantially only the shallow flank 235 is in contact with the opposite mating face 121. In the preferred embodiment, the flank angle difference is about 65 degrees. Thirdly, the second flank angle 233A is selected such that during the substantially radial compression the steep flank 233 is deformed into an undercutting angle 233U that is preferably about equal a well known friction angle in the radial contact pressure area CA for a predetermined material selection and surface configuration of opposing mating face 121 and shallow flank 235. The second flank angle 233A is preferably about 90 degrees for a standard polished injection mold surface of an injection mold in which the mating face 121 and the shallow flank 235 may be molded from a commercially available material Santoprene™ 203-40.

The opposing mating face 121 and the shallow flank 235 may feature a sealing surface configuration, which may include a high surface smoothness. As a favorable result and during the operational substantially radial compression, the flexible ribs 230 may be in circumferentially continuous one directional sealing contact with the opposing mating face 121. While the connector interface 121, 221, 230 is engaged, an interface cavity 319 adjacent the shallow flank 235 is compressed along the insertion axis IA. Pressurized Fluid such as air in an interface cavity 319 is capable of venting through in between the shallow flank 235 and the opposing mating face 121. To the contrary and while the connector interface 121, 221, 230 is forced to disengage, the interface cavity 319 is expanding and the fluid pressure in the interface cavity 319 may decrease. The pressure difference between decreasing interface cavity 319 pressure and an ambient fluid pressure may result in an excess pressure on the steep flank 233 resulting in a radial expansion of the undercutting deformed rib portion RU similar as described for the asymmetric friction resistance. The radial expansion results in an increased sealing effect particular in between the undercutting deformed rib portion RU and the opposing mating face 121 such that an ambient fluid such as air is substantially hampered to flow back into the interface cavity 319. The pressure difference acts on the entire cross section of the tubular protrusion 220 and the steep flank 233 in combination with the one directional sealing effect and assists in opposing a disengaging movement in the connector interface 121, 221, 230 as may be clear to anyone skilled in the art. Geometric conditions of the flexible ribs 230 for the one directional sealing effect are similar as described for the asymmetric friction resistance.

As depicted in FIGS. 1, 2, the flexible ribs 230 may be monolithically fabricated together with a mating protrusion 220 that provides the mating face 221 in a radially outward facing configuration. Fabricating the flexible ribs 230 in a radially outward facing configuration is preferable especially in case of employed well known injection molding fabrication techniques. Nevertheless, the present invention may include embodiments in which a flexible rib 230 may be fabricated on the mating face 121 in a radially inward facing configuration. The mating face 121 may be part of the mating receptacle 120 of the connector 300.

Moreover, the flexible ribs 230 may be monolithically fabricated together with the entire housing 203 of the connector 100. In the preferred and depicted case of the connector 100 being an electric connector, the housing 203 may also include a well known cable strain relief 205 encompassing an exiting cable 303 of the connector 100. A conductive cable core 307 may be conductively connected to a central contact pin 309 that is aligned with the insertion axis IA. A well known pin spring 315 may also be axially fixed on the central contact pin 309. The central contact pin 309 together with pin spring 315 may fit into a contact sleeve 109 of the connector 300. The contact sleeve 109 in turn may fit into the inside 219 of the mating protrusion 220. Irrespective the preferred configuration of the connector 100 as a single pin electric connector, the scope of the invention may be applied to any other connectors as may be well appreciated by anyone skilled in the art. Such connectors may include but are not limited to multi pin electrical connectors and optical connectors.

To connect connectors 100, 300 via their connector interface 121, 221, 230, the connectors 100, 300 are approached with their respective mating protrusion 220 and mating receptacle 120 axially aligned with respect to the insertion axis IA and moved together such that the mating protrusion 220 is inserted into the mating receptacle 120 and the connector interface 121, 221, 230 engages. As the flexible ribs 230 contact the opposing mating face 121 they become substantially radially compressed. As described above sliding friction and/or fluid flow resistance remain low during engaging of the connector interface 121, 221, 230. During operation when unintentional disengaging forces may act onto the connector interface 121, 221, 230, the high friction resistance HR and/or hampered fluid flow may assist in keeping the connector interface 121, 221, 230 together as well as the connector pin 309 and the connector sleeve 109. During intentional disengaging of the two connectors 100, 300 a disengaging force may be applied that is sufficiently high to overcome the high friction resistance HR and/or the hampered fluid flow and its corresponding vacuum effect of the interface cavity 319.

Accordingly, the scope of the invention described in the Figures and the above Specification is set forth by the following claims and their legal equivalent:

What is claimed is:

1. A connector, comprising:

a mating protrusion having an insertion axis and a mating face; and at least one flexible rib being part of and extending above the mating face, wherein the at least one flexible rib propagates substantially continuously around a circumference of the mating face, the at least one flexible rib having a saw-tooth cross section including a steep flank and a shallow flank, wherein the shallow flank comprises a first flank angle with respect to the insertion axis and the steep flank comprises a second flank angle with respect to the insertion axis, wherein a flank angle difference between the first flank angle and the second flank angle is configured such that when the connector is coupled to a complementary connector, the shallow flank is in substantial pressure contact with a mating face of the complementary connector, and the steep flank is substantially free of contact with the mating face of the complementary connector, and wherein the steep flank joins the shallow flank at a sharp circumferential edge.

2. The connector of claim 1, wherein the at least one flexible rib is configured to provide an insertion resistance and a disengaging resistance with respect to the complementary connector, wherein the disengaging resistance is higher than the insertion resistance.

3. The connector of claim 2, wherein the disengaging resistance comprises:

a fluid-pressure force; and a frictional force.

4. A connector, comprising:

a mating face disposed along an insertion axis;

at least one flexible rib extending away from the mating face and being substantially continuous around a circumference of the mating face, wherein the at least one flexible rib comprises a steep flank and a shallow flank, wherein the at least one flexible rib is configured such that, when the connector is coupled to a complementary connector, the shallow flank is compressed against a mating face of the complementary connector, and the steep flank is substantially free of contact with the mating face of the complementary connector, and wherein the shallow flank comprises a first flank angle with respect to the insertion axis, the steep flank comprises a second flank angle with respect to the insertion axis, and the difference between the first and the second flank angle is about 65 degrees.

5. The connector of claim 4, the at least one flexible rib configured to form a substantially air-tight seal against the mating face of the complementary connector when the connector is coupled to the complementary connector.

6. The connector of claim 4, the at least one flexible rib configured to increase a pressure between the at least one flexible rib and the mating face of the complementary connector when either the connector or the complementary connector is subjected to a disengaging force.

7. The connector of claim 4, wherein the steep flank is configured to deflect from about 90 degrees to about 45 degrees when the connector and the complementary connector are coupled.

8. The connector of claim 4, wherein the at least one flexible rib has a base to height ratio of about 2.

9. The connector of claim 4, wherein the shallow flank is facing an insertion direction, and the steep flank is facing a retraction direction.

10. The connector of claim 4, wherein the circumference is an inner circumference.

11. The connector of claim 4, wherein the circumference is an outer circumference.

12. The connector of claim 4, wherein the connector is a plug, and the complementary connector is a receptacle.

13. The connector of claim 4, wherein the connector is a receptacle, and the complementary connector is a plug.

14. The connector of claim 4, wherein the connector is configured such that, when the connector is coupled to the complementary connector, an interface cavity is formed, the interface cavity bounded by at least the mating face, the at least one flexible rib, and the mating face of the complementary connector.

15. The connector of claim 14, the at least one flexible rib configured such that, if subjected to a disengaging force, a fluid pressure in the interface cavity is reduced.

16. The connector of claim 4, wherein the at least one flexible rib is configured to provide an insertion resistance and a disengaging resistance, wherein the disengaging resistance is higher than the insertion resistance.

17. The connector of claim 16, wherein the disengaging resistance comprises:

a fluid-pressure force; and a frictional force.

18. A connector, comprising:

a mating face disposed along an insertion axis; and at least one flexible rib extending away from the mating face and being substantially continuous around a circumference of the first mating face, wherein the at least one flexible rib comprises a steep flank and a shallow flank, wherein the at least one flexible rib is configured to provide an insertion resistance and a disengaging resistance with respect to a complementary connector, the disengaging resistance being higher than the insertion resistance, wherein the steep flank is configured to deflect from about 90 degrees to about 45 degrees when the connector and the complementary connector are coupled, and wherein the at least one flexible rib is configured to form a substantially air-tight seal against a mating face of the complementary connector.

19. The connector of claim 18, the at least one flexible rib configured to increase a compression force between the at least one flexible rib and a mating face of the complementary connector when either the connector or the complementary connector is subjected to a disengaging force.

20. The connector of claim 18, wherein the disengaging resistance comprises:

a fluid-pressure force; and a frictional force.

21. The connector of claim 18, wherein the at least one flexible rib is configured such that, when the connector is coupled to the complementary connector, the shallow flank is compressed against a mating face of the complementary connector, and the steep flank is substantially free of contact with the mating face of the complementary connector.

22. The connector of claim 18, wherein the circumference is an inner circumference.

23. The connector of claim 18, wherein the circumference is an outer circumference.

24. The connector of claim 18, wherein the connector is a plug, and the complementary connector is a receptacle.

25. The connector of claim 18, wherein the connector is a receptacle, and the complementary connector is a plug.

* * * * *